United States Patent [19]

Morrison et al.

[11] 4,240,638

[45] Dec. 23, 1980

[54] MICROPROCESSOR CONTROLLED GAME APPARATUS

[75] Inventors: Howard J. Morrison, Deerfield, Ill.; Ralph H. Baer, Manchester, N.H.; Jeffrey D. Breslow, Highland Park, Ill.

[73] Assignee: Marvin Glass & Associates, Chicago, Ill.

[21] Appl. No.: 867,583

[22] Filed: Jan. 6, 1978

[51] Int. Cl.[3] ..... A63F 9/00

[52] U.S. Cl. ..... 273/237; 273/1 E; 273/138 A; 273/153 R

[58] Field of Search ..... 273/85 G, 237, DIG. 28, 273/88, 94 R, 1 M, 1 G, 1 I, 273, 275, 153; 35/9 C, 6, 22 R; 340/323 R

[56] References Cited

U.S. PATENT DOCUMENTS

| | | | |
|---|---|---|---|
| 2,808,263 | 10/1957 | Goldfinger et al. | 35/22 R |
| 3,024,020 | 3/1962 | Alton | 35/22 R |
| 3,562,927 | 2/1971 | Moskowitz | 35/22 R |
| 3,735,381 | 5/1973 | Zadig | 35/22 R |
| 3,777,410 | 12/1973 | Robinson | 273/DIG. 28 X |
| 3,778,058 | 12/1973 | Rausch | 273/85 G |
| 3,874,669 | 4/1975 | Ariano | 273/85 G |
| 3,902,723 | 9/1975 | Colling et al. | 273/237 |
| 4,017,072 | 4/1977 | Kurtz | 273/237 X |
| 4,026,555 | 5/1977 | Kirschner et al. | 273/85 G |
| 4,057,253 | 11/1977 | Csoka | 273/153 R |
| 4,082,285 | 4/1978 | Bathurst | 273/237 |
| 4,103,895 | 8/1978 | Pressman et al. | 273/153 |

OTHER PUBLICATIONS

*"Touch-Me" Operating and Maintenance Manual*; 1974; pp. 1-8.

*Primary Examiner*—Vance Y. Hum

*Attorney, Agent, or Firm*—Mason, Kolehmainen, Rathburn & Wyss

[57] ABSTRACT

An electronic game having a field of play arranged in an array as a key board of individually operable key pad switches defining array positions on which one or more players attempt to discover a hidden maze path from a designated starting point. A player wins or completes the game when the maze path is traversed from start to finish. The device utilizes a microprocessor to control the progress of the game, generate different maze paths for each play of the game, monitor the entry of key board information, and control the output of indications to the players as to the progress of the game. The microprocessor also controls the generation of distinct aural tones and/or tone sequences representing each players' turn, incorrect moves, not responding within the time period for a move, the duration of each player's turn, and a game completion message. In an alternative scheme of play, two players start at opposite ends of a common maze path and attempt to reach other others' starting point. In other schemes of play, penalties are programmed into the microprocessor requiring a player to return to start upon operation of an incorrect key pad. The microprocessor in other schemes of play is programmed to control reaction/memory games. For example, one or more players actuate key pad switches until eliminated upon operation of a key pad switch position previously operated, the players attempting to remember the status of active/inactive array positions or key pads.

22 Claims, 7 Drawing Figures

Fig 1
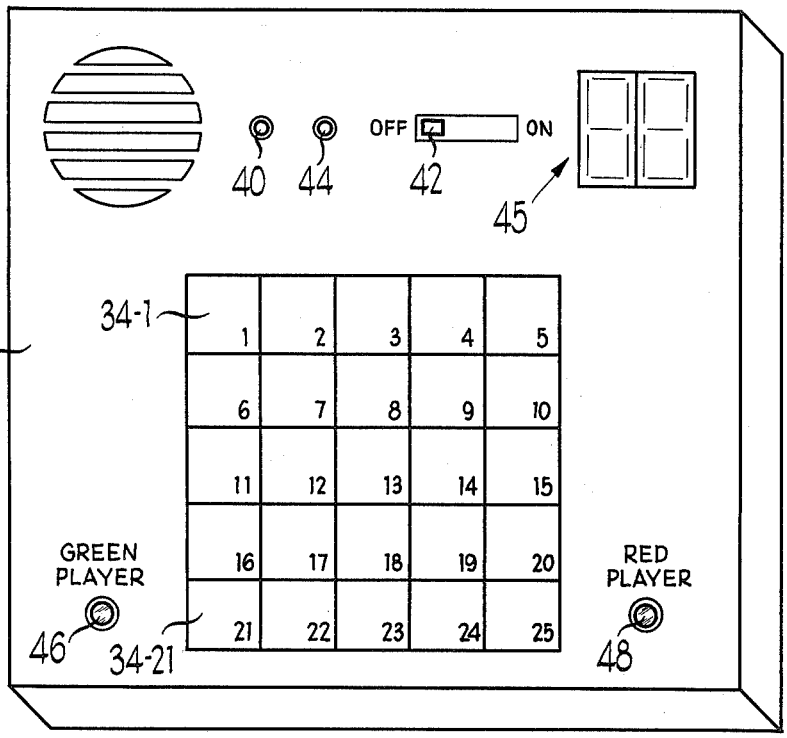
Fig 2
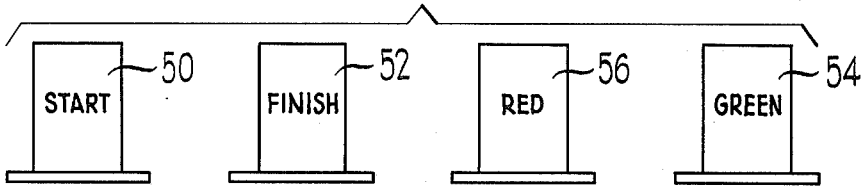
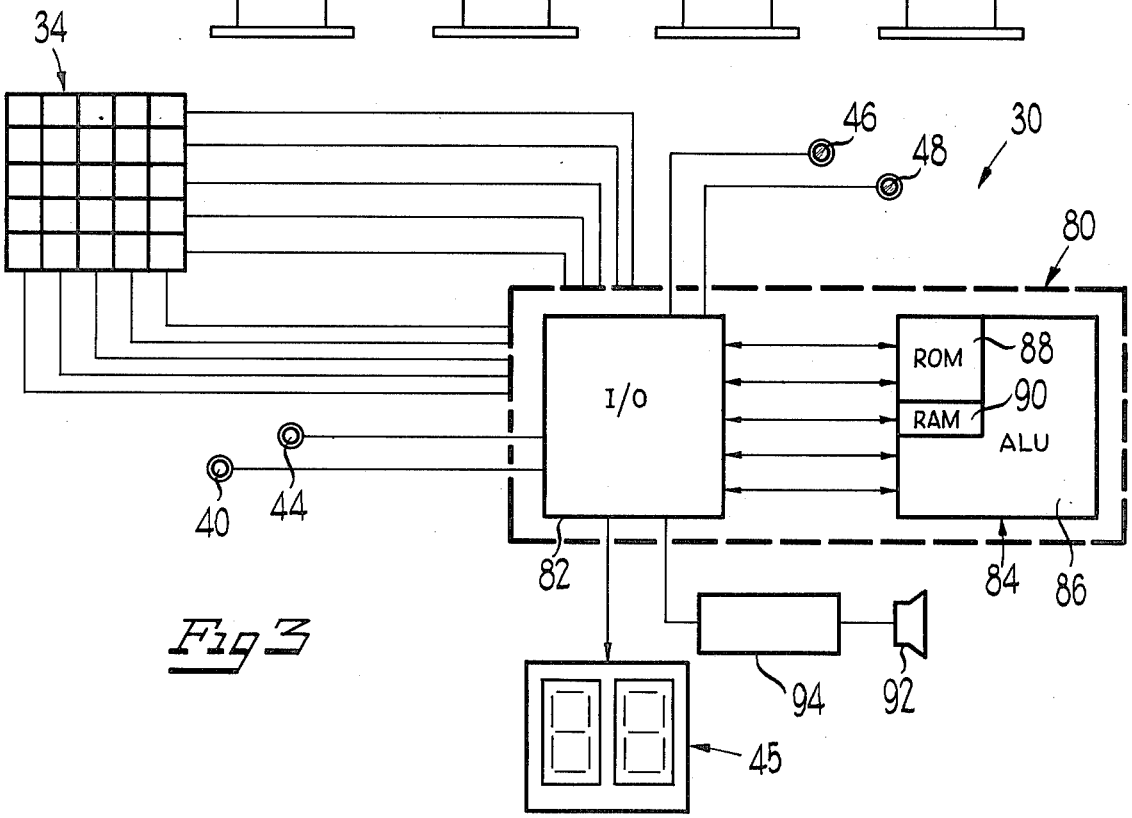
Fig 3

B
A
INITIALIZE TURN TIMER
DECREMENT TURN TIMER
TURN TIME UP ?
YES
NO
D
INCREMENT ROUND COUNT
F
READ SWITCH CONTROL IND.
OUTPUT TONE ?
YES
NO
ENABLE TONE GENERATOR
DISABLE TONE GENERATOR
DONE MELODY ?
NO
YES
DETERMINE NEXT TONE TYPE
GAME END MELODY ?
YES
E
NO
NEW MELODY ?
YES
NO
DETERMINE MELODY TYPE
C

MICROPROCESSOR CONTROLLED GAME APPARATUS

BACKGROUND OF THE INVENTION

A. Field of the Invention

This invention relates generally to games and more particularly to an electronic board game that provides aural and visual indications of the progress of the game to the game participant.

B. Description of the Prior Art

Various board games are known wherein a matrix arranged play area or array of playing elements are utilized over which players move tokens in a manner described by the rules of the game.

For example, U.S. Pat. No. 3,902,723 which issued to B. Colling et al on Sept. 2, 1975 discloses an electronic board game having a start position and a stop position with each player moving an indicator or a counter from the start position to the stop position in response to randomly generated instructions from the machine. Instructions are generated in a random sequence and each player strives to stop the machine when an instruction that is advantageous to him is generated.

Another electronic board game wherein a counter is moved from one location to another along a matrix is described in U.S. Pat. No. 4,017,072 which issued to L. C. Kurtz on Apr. 12, 1977. The matrix includes a plurality of scoring elements for each player and the object of the game is for each player to attempt to place the counter on one of his scoring elements while preventing the other player from doing the same.

Another board game utilizing a matrix array is disclosed in U.S. Pat. No. 4,057,253 which issued to F. S. Csoka on Nov. 8, 1977. In this game, each player is provided with a game board and each player draws a maze path or selects a maze path from a deck of maze path cards. Each player conceals his maze path from the other player. A token piece is used for moving in steps from one array position to another as the maze path is defined. Each player attempts to define the concealed maze path of the other by asking questions.

While the above described game devices are generally suitable according to their intended use and provide amusement and interest, there is a constant need for improved electronic board game devices.

SUMMARY OF THE INVENTION

Accordingly, it is an object of the present invention to provide an electronic game utilizing an array or key board that controls the interaction between one or more participants and/or the machine itself and provides a test of the participants' memory and reaction while also providing an interesting amusement device.

It is another object of the present invention to provide a key board game device that automatically, internally generates a random pattern which the participant or participants attempt to define while testing the memory and concentration of the participants.

In accordance with a preferred embodiment of the invention, there is provided a device having a field of play arranged in an array of key board positions on which one or more players attempt to discover a maze path. A player wins or completes the game when the maze path is properly entered from start to finish. Each of the key board positions is defined by an individually operable key pad switch. The device utilizes a microprocessor programmed to generate different maze paths for each play of the game and to control the process of the game. The microprocessor is also programmed to monitor the entry of key board information, control the output of indications to the players and the generation of distinct tone sequences representing each player's turn, incorrect moves, not responding within the time period for a move, the duration of each player's turn, and a game completion message. The start and finish position of the maze are displayed to the players at the start of the game. Subsequently, as the players attempt to define the maze path, the players attempt to remember the previous correct and incorrect moves by all players with respect to the maze path to aid in selecting future moves during their respective turns.

In an alternative embodiment, the two players start at opposite ends of a common maze path and attempt to reach each others starting point.

In other alternative embodiments, one or more players attempt to define programmed maze path and are penalized for incorrect moves. At the start of each turn, a player is required to enter the correct maze path from the start position.

In other alternative embodiments, the microprocessor is programmed to control reaction/memory games wherein one or more players attempt to operate key board positions of the array without operating a previously operated key board position as play continues or attempt to operate successive, adjacent key board positions in a continuous path without entering a noncontinuous path sequence, a dead end or a previously operated array position.

DESCRIPTION OF THE DRAWINGS

These and other objects and advantages of the present invention will become apparent by reference to the following description taken in conjunction with the accompanying drawings wherein:

FIG. 1 is a perspective view of the preferred embodiments of a device according to the invention;

FIG. 2 is an elevational view of several playing pieces or markers utilized in connection with the device of FIG. 1 in accordance with the present invention;

FIG. 3 is a block diagram of the electrical components of the game according to the invention.

DETAILED DESCRIPTION OF THE PREFERRED EMBODIMENT

Figure 4:
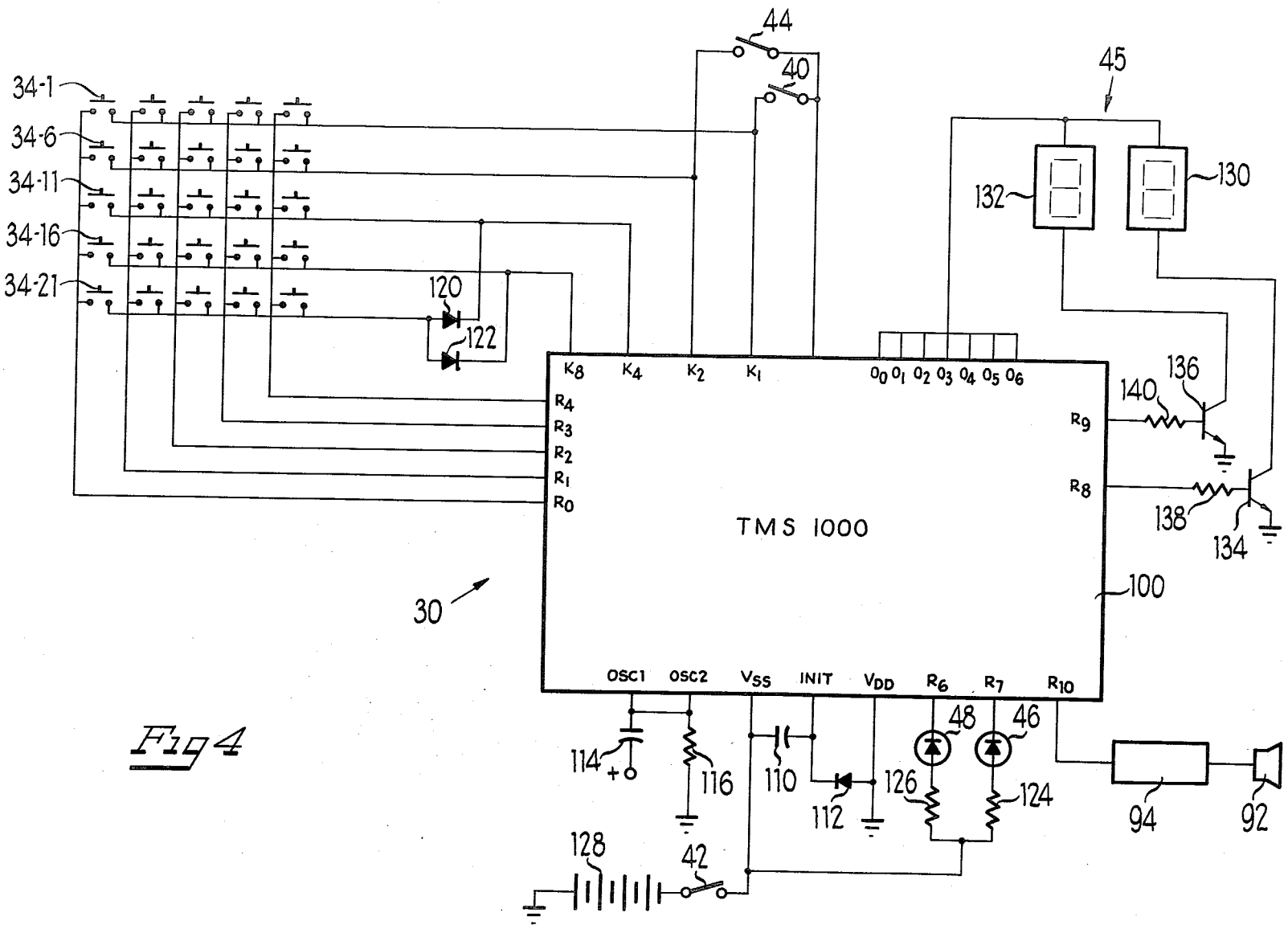
FIG. 4 is a detailed schematic diagram of the electronic circuitry of the game according to the present invention.

Referring now to the drawings, with particular attention to FIG. 1, there is shown an embodiment of the game according to the present invention generally designated by the reference numeral 30. The game 30 includes a housing 32 that carries an array of individually operable key pad switches 34 defining a field of play. In a specific embodiment illustrated in FIG. 1, an array of five rows and five columns defines a field of play having 25 individually operable key pad switches or positions which may be referred to as 34-1 through 34-25; each row being numbered from left to right and from top to bottom.

In various embodiments, each of the key pad switches are respectively associated with indicia such as numerals, letters or other symbols. The indicia may be arranged on the key pad switches in a predetermined order or pattern such as in rows from left to right in an order from top to bottom whereupon the upper left key pad switch is referred to as array position 1 and a lower right hand key pad switch as 25. In other specific embodiments, the indicia are randomly arranged about the array rendering it more difficult to play the game and requiring the players to remember or associate particular array positions with respect to the overall pattern rather then by memory association techniques as would be possible with an ordered indicia arrangement.

Alternatively, no indicia are provided requiring a complete association or recall by array position. If no indicia are provided, the various array positions displayed during the play of the game may be identified as row and column elements.

In the following description, the specific embodiment illustrated in FIG. 1 utilizes numerical indicia. However, it should be understood that this described arrangement is intended as illustrative and not in a limiting sense. In a specific embodiment, each of the key pad switches 34-1 through 34-25 is provided with an indicator device either under the control of the respective key pad switches or a microprocessor programmed to control the progress of the game.

A game selector, push button switch 40 permits the user to select one of several types of games playable by the device. Each operation of the game selector switch 40 advances the device to a new type of game. An on/off slide switch 42 is provided to control the operational state of the device and the connection of an internal battery supply to the electronic circuitry. A start, push button switch 44 is provided to initiate a play of the game as selected on the game selector switch 40. A display 45 in a specific embodiment comprising two seven bar or segmented LED indicators is also provided to indicate the type of game selected, to provide information as to the start and finish points of a particular game, to indicate the score of the game, and to perform other indicator functions as will be explained in more detail hereinafter.

Two LED indicators 46 and 48 are provided on the housing 32 one for each game player to indicate the turn of the particular player. In a specific embodiment, one indicator 46 is a green LED and the other indicator 48 is a red LED. Thus, in this specific embodiment, two game players are referred to as the green player and the red player.

Several types of games may be played by the device 30 illustrated in FIG. 1. A type of game is selected by appropriately operating the game selector switch 40. Eight types of games are described below. However, the microprocessor (described in a subsequent portion of the specification) may be programmed to play various other types of games as well. Thus, the eight types of games described below should be interpreted as illustrative of the games that can be played.

Referring now additionally to FIG. 2, the game device 30 includes a start reference marker 50 and a finish reference marker 52 which are utilized in the play of several specific types of games. The start marker 50 and the finish marker 52 are suitably shaped elements having a base dimension approximately equal to or slightly less than that of the key pad switches 34 and are positionable about the array. A red moving token 56 and a green moving token 54 are also provided as positionable elements independent of the housing 32 to indicate the position of each of the players at respective positions on the array.

GAME 1

With the on/off switch 42 positioned to the on position, the type of game programmed as Game 1 of the device will be activated when the start game, push button switch 44 is operated. In the Game 1 type of game, two players start from a defined point on the field of play or array and take turns in an attempt to move toward a common identified finish point. The players move their respective markers one array position at a time as long as correct directional moves are entered by pressing or operating key pad switches. The microprocessor of the game device generates a random, continuous maze path unknown to the players defining a start and finish point and compares the generated maze path to the entries of the players determined by operation of the respective key pad switches.

At the start of the play of the game, the display 45 will indicate P1 signifying Game 1 has been selected. The game device is initialized by the internal electronic circuitry of the microprocessor to Game 1 operation. If the game device has previously been operated, the game selector button 40 is operated until the display 45 indicates P1. When the start push button switch 45 is operated, the display 44 blanks (in a non-displaying mode) for approximately two seconds. The display 45 then indicates the designation or number of the START array position and continues to indicate this array position designation. The players place the start reference marker 50 on the array position indicated on the display and enter the start position by operating the key pad switch to verify the correct location. In this regard and in the preferred scheme of play, the players utilize the start marker 50, the finish marker 52, and the green and red moving tokens 54 and 56 respectively to operate the key pad switches.

An incorrect tone or tone sequence is generated by the game device if the array position entered is not in agreement with the start location designation and the start position continues to be displayed. If the entry is correct, the display blanks for one second. Then the display indicates the designation of the FINISH array position in an intermittent or blinking manner whereupon the finish marker 52 is positioned on the designated array position and the respective key pad switch operated to enter and verify the correct location. The displayed FINISH array position will extinquish when the correct key pad switch is operated and entered.

Next the green player LED 46 is actuated and the green player tone sequence is generated to signal the start of the green players turn. The green LED 46 remains actuated for the duration of the green players turn, ten seconds in a specific embodiment. During the interval of the green players turn, a timing tone sequence is generated, for example a "tick-tock" signal.

The green player proceeds to place his green moving token 54 on an array position he believes to be the next position in the maze path and operates the respective key pad switch to enter his move. The position referred to as the next position in the maze path is defined with respect to the position on which the green player moving token 54 is positioned prior to the beginning of the turn; for example, the start position if this is the first turn in a game. If prior turns have been taken and correct positions of the maze path have been previously entered, the green player moving token 54 would be positioned on the last correct position entered in that previous turn.

If the green player enters an incorrect position as compared against the maze path in memory of the microprocessor, or if he fails to operate the key pad switch within the alotted turn time interval (referred to as excessive time), the timing tone signal ceases and a one second incorrect tone sequence is generated. The incorrect tone sequence in a specific embodiment is an aural message recognized as an incorrect response such as a "rasberry sound".

If a green player has entered a correct array position as compared to the maze path sequence in the memory of the microprocessor, the green player tone sequence is again generated and the green player LED 46 remains actuated for another turn time interval with the timing tone sequence being generated. The green player selects a new array position in an attempt to locate the next position in the maze path. Again, if this new entered position is incorrect or if the green player fails to enter a position within the alotted turn time interval, an incorrect tone sequence is generated and the green LED 46 extinquishes. The turn of the green player continues until an incorrect entry or a failure to enter a position within the prescribed time occurs. At that point, the green LED 46 extinquishes and the red player LED 48 is actuated and the red player tone sequence generated to start the red players turn.

The red player proceeds to place the red moving token 56 on what he believes to be the next array position corresponding to the maze path and enters his move by operation of the respective key pad switch as before. The red players turn continues until an incorrect array position is entered or upon failure to enter a response or move within the turn time interval. At that point, the red player turn ends and the red player moving token 56 remains positioned on the last array position of the maze path correctly entered or the start position if no correct entries have been previously entered by the red player.

In this game type, Game 1, the first player to reach the FINISH array position along the maze path as defined in the memory of the microprocessor is the winner. The winner and the successful completion of the game are indicated by a winner's tone sequence being generated and the respective LED of the winner being intermittently actuated, for example blinking ten times during a ten second interval. The display 45 indicates the score of the winner, in a specific embodiment equal to the number of turns required by the winner to reach the designated FINISH location.

After indication of the winner's score, the display extinquishes and then indicates the selected game number, P1 for example. The device 30 is then ready for a new game upon actuation of the START push button 44. Since a new turn is started for each correct entry, incorrect entry, or excessive time out, the winner's score is the total number of correct and incorrect moves including both key pad switch entries and the excessive turn time out without an entry.

Thus, during the play of the game, each of the players attempts to remember the maze path defined during the play and also the incorrect moves by both players to aid in defining the next proper array position of the maze path.

GAME 2

By positioning the game selector switch 40 to the Game 2 position and operating the start game button 44, the device 30 is conditioned to select and control the operation of Game 2. In this type of game, the players enter their moves by operation of the key pad switches and attempt to ascertain the maze path on the array as described in connection with Game 1.

However, in Game 2 each of the players starts from an opposite end of the maze path and traverses the maze toward the other player's starting point. Thus, the display 45 at the start of the game indicates the START array position for the red player while the red LED 48 is actuated and the red player tone sequence is generated. After the red player places his marker on the designated start position and enters the position by operation of the respective key pad switch, the greed LED 46 is actuated, the green player tone sequence is generated and the display 45 indicates the green player START position. In this game, a red start marker and a green start marker is provided and the players utilize their respective moving tokens to identify their respective positions along the maze path during play. Play proceeds in accordance with the scheme of play outlined in connection with Game 1 with the players taking alternate turns. The game is successfully completed when one of the players reaches the starting point of the other player with a win being indicated in accordance with the description of Game 1.

GAME 3

When the push button game selection switch 40 is operated to the Game 3 position with the display 45 indicating P3, the device is conditioned by the microprocessor to the Game 3 operational state. The play of the Game 3 type proceeds similarly to that of Game 1 with the additional provision of a penalty for incorrect moves or entries. Thus, after an incorrect entry or excessive time out, each player repositions his respective moving token back to the designated START position and enters the position by operation of the corresponding start key pad switch to verify that he has returned to start. At the start of each new turn, each player proceeds from the original designated START position and enters all the array positions in sequence to reproduce the maze path defined up to that point in time as ascertained from previous turns. The entry of the start position at the end of one players turn initiates the next players turn.

GAME 4

Upon the operation of the game selector switch 44, the device is conditioned for Game 4 operation and the display 45 indicates P4. The play of the game proceeds similarly to that of the Game 2 type wherein each player starts from opposite ends of the maze and proceeds toward the others starting point. However, upon each incorrect entry or excessive time out, the game players move their respective tokens to the original designated start position for the particular game player. Thus, each game player is penalized for incorrect entries or excessive time outs by returning to the original start position. Thus, each player between turns must remember the maze path as defined by previous turns and moves.

GAME 5

When the device is conditioned to the Game 5 operation, the display 45 indicates P5. Upon operation of the start switch 44, the display after a blanking interval indicates the designation of the start array position and the play of the game proceeds similarly to that of Game 1. However, the Game 5 type is for a single game player. After the correct entry of the start and finish array positions and the appropriate positioning of the start and finish markers, the player attempts to define the maze path by moving his moving token and entering positions by operating the key pad switches. The turn time intervals, and incorrect tone sequence and the green player tone sequence for a correct entry are all generated similarly to that of Game 1 for the green player only.

GAME 6

For Game 6 type of operation, a single player attempts to define the hidden maze path between the designated start and finish array positions with the penalty provisions outlined in connection with the discussion of Game 3. The single player conditions discussed in connection with Game 5 also apply.

GAME 7

In Game 7, the device is conditioned for play of a reaction/memory game for two or more players. The object in this game is to enter an array position which has been been previously entered during the play of the game referred to as an active position. Play proceeds by the players alternately entering array positions while remembering those array positions that have been previosly entered by any of the players. The display indicates the number of array positions remaining in the active state at that point in play thus indicating the number of active play positions remaining for entry. Players are eliminated from play when they enter an array position previously entered. When one player remains, the game is ended and that player is declared the winner.

GAME 8

In Game 8, two or more players proceed to define or generate a path from a designated START position with the first player entering an array position adjacent to that of the start position. A second player must then enter an array position adjacent to that of the position entered by the first player. Similarly, as play continues in alternating fashion among the players, each successive entry by a player to be considered a correct entry must represent an array position adjacent that of the immediately preceding entry while not being a previously entered position, a position which represents a "dead end" or a position from which a continuous path may not continue. When a player enters an incorrect position, he is eliminated from play and the remaining players start a new play of the game. When one player remains, that player is declared the winner and the game is successfully completed.

Referring now to FIG. 3, the game device 30 utilizes a microprocessor 80 having an input/output section 82 connecting the key pad switches 34 to a computing device 84 having an arithmetic logic unit 86, a read only memory 88 and a random-access memory 90. The arithmetic logic unit 86 processes the inputs received from the various input devices in accordance with the game type selected from the read only memory 88 by the game selector switch 40. The arithmetic logic unit 86 through the input/output section 82 also controls the operation of the indicators 46 and 48, the display 45 and a loud speaker 92 with associated control circuitry 94 in accordance with the rules of the games selected.

Thus, when one of the games stored in the read only memory is selected by the switch 40, the arithmetic logic unit 86 operates on the sample inputs from the array of key pad switches 34-1 through 34-25 to perform the necessary arithmetic logic steps and to store the necessary data such as the operation of a correct key pad switch in the maze path sequence in the random-access memory 90. The arithmetic logic unit 86 also controls the input/output section 82 to provide the necessary responses to the game players by appropriately actuating the indicators 46 and 48, producing the appropriate tone sequences or melodies through the loud speaker 92 and controlling the indicating state of the display 45.

Referring now to FIG. 4, the device 30 illustrated in FIGS. 1, 2 and 3 is readily implemented by a single chip, large scale integrated circuit microprocessor 100 as the main computing device. A TMS 1000 single chip microprocessor manufactured by Texas Instruments, Inc., is suitable for use as the microprocessor 100 and contains the input/output circuitry 82 and the computing device 84 illustrated in FIG. 3.

A time delay circuit comprising a capacitor 110 and a diode 112 are utilized to reset and initialize the operation of the microprocessor 100 each time the power is turned on. A timing circuit comprising a capacitor 114 and a resistor 116 control the operation of the internal clock or oscillator of the microprocessor 100. The time delay circuit and timing circuit described above are selected in accordance with the design data in a manner described in the TMS 1000 series data manual published in December, 1975, by Texas Instruments, Inc. Further, the microprocessor 100 is readily programmed in a manner described in this data manual to perform the functions necessary to play the game types as described hereinbefore. In this regard, program listings describing the program steps necessary to play a typical game are attached as Appendix A.

In operation and during the play of the game, the microprocessor 100 monitors the state of the key pad switches 34-1 through 34-25, the game selector switch 40, and the start switch 44 by sequentially energizing its outputs R0 through R5 while monitoring the inputs K1, K2, K4 and K8.

The R0 through R4 outputs are respectively connected to columns 1 through 5 of the key pad switch array; that is the R0 output is connected to one switch contact of each of the key pad switches identified as 34-1, 34-6, 34-11, 34-16 and 34-21. Similarly, the K1, K2, K4 and K8 inputs are respectively connected to one switch contact of each key pad switch in rows 1 through 4 of the key pad switch array; for example the K1 input is connected to one switch contact of each of the key pad switches 34-1 through 34-5. The key pad switch contacts of the fifth row, 34-21 through 25, are connected through a first diode 120 to the K4 input and through a second diode 122 to the K8 input.

Thus, when the output R0 is energized, the device determines the state of the key pad switches in the first column by monitoring the K1, K2, K4 and K8 inputs. For example, if the key pad switch 34-21 (column 1 row 5) is actuated the R0 output energizes the K4 and K8 inputs interpreted by the input circuitry of the microprocessor 100 as the actuation of the key pad switch 34-21. Similarly, the outputs R1 through R4 are energized while monitoring the K1, K2, K4 and K8 inputs to determine the state of the key pad switches in the second, third, fourth and fifth columns respectively. The R5 output is connected through the game selector switch 40 and the start switch 44 to the K1 and K2 inputs respectively to monitor the state of these switches during the R5 sequential output interval.

The R6 and R7 outputs are utilized to sequentially drive the red player LED indicator 48 and the green player LED indicator 46. The indicators 46 and 48 are connected to the switched supply voltage $V_{ss}$ through respective resistors 124 and 126. The switched voltage $V_{ss}$ is connected through the on/off switch 42 to the positive terminal of a battery source connection and a suitable battery source 128. The R8 and R9 outputs sequentially energize the right and left display elements 130 and 132 respectively of the display 45 through respective NPN transistors 134 and 136. A series drive resistor 138 and 140 is connected respectively between the R8 and R9 inputs and the respective base electrodes of the transistors 134 and 136. The emitter electrodes of each of the transistors 134 and 136 are connected to ground potential or the negative battery terminal. The collector of transistor 134 is connected to energize the display element 130 and the collector of transistor 136 is connected to the display element 132. The $O_0$ through $O_7$ outputs of the microprocessor 100 are utilized to drive the respective segments of the display elements 130 and 132 in accordance with the control signals to the output circuitry of the microprocessor 100 from the computing device 84. The outputs $O_0$ through $O_7$ controlling the display element 132 during the R9 sequential output interval and the display element 130 during the R8 sequential output interval.

The various tone sequences or melodies produced through the loud speaker 92 and audio control circuitry 94 are generated under the control of the R10 output of the microprocessor 100. In a specific embodiment, the repetition rate of the output R10 during sequential output intervals is utilized to provide the distinct tone and tone sequences including the green player song, the red player song, the end of game-winner song, the incorrect move song, and the timing tones during the turn interval. The generation of various tone sequences and melodies will be described in more detail along with a more detailed discussion of the programming and control of the game by the microprocessor 100 in connection with FIGS. 5 through 7.

Figure 7:
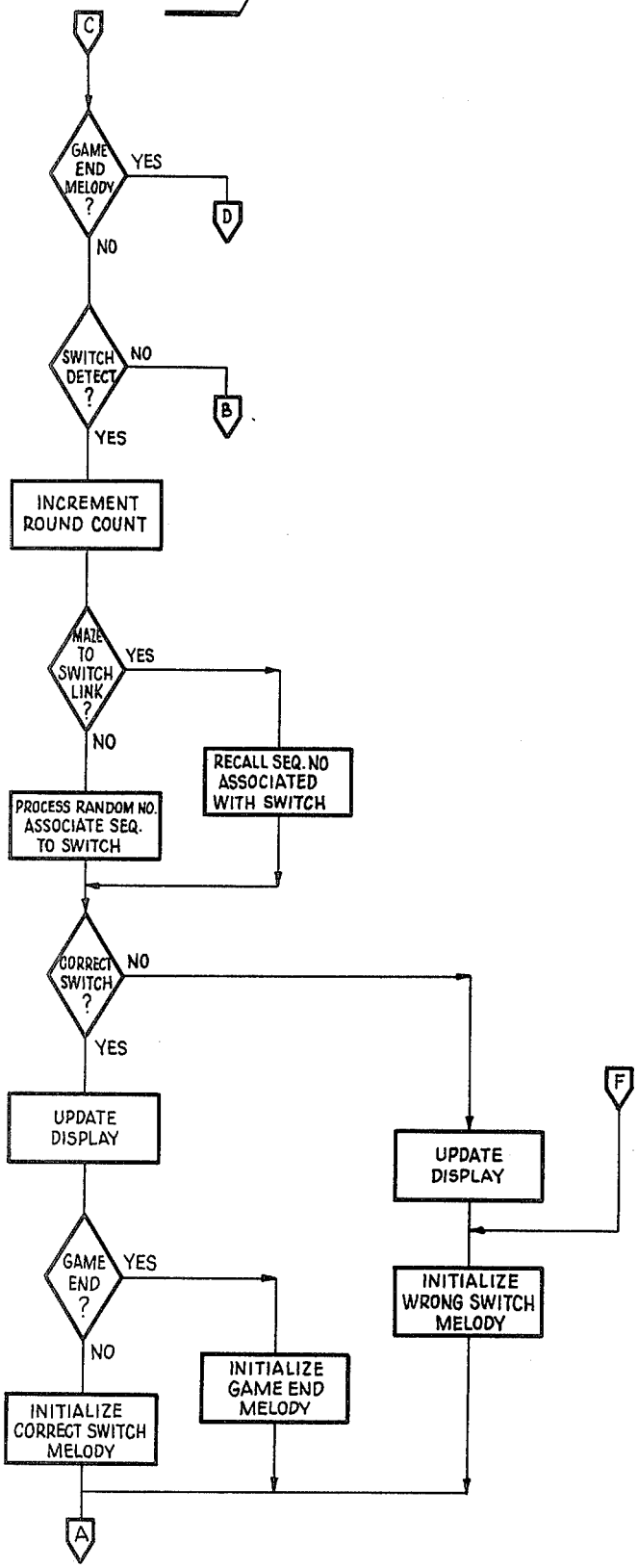
FIGS. 5 through 7 are logical flow diagrams illustrating the functions performed by the microprocessor controlling the operation of the game according to the invention.
Figure 5:
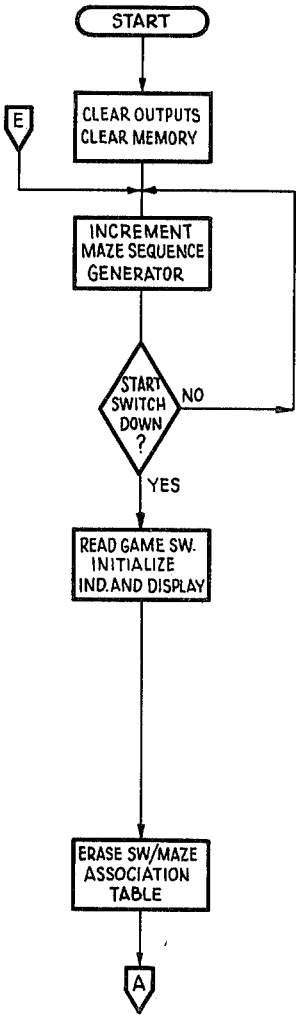
Figure 6:
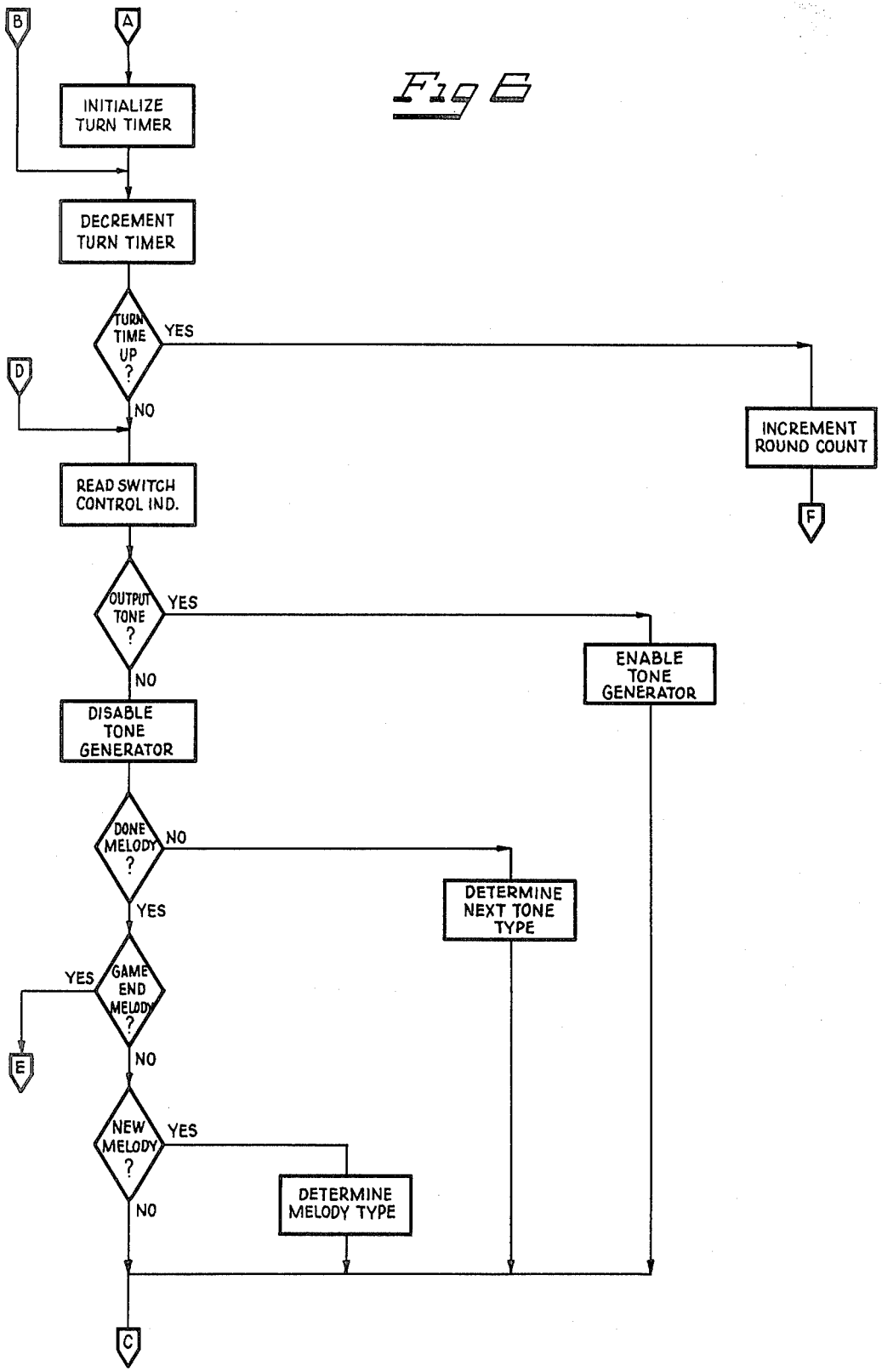

Referring now to FIGS. 5 through 7, flow charts describing the functions performed by the micrprocessor 100 to control the operation of the game according to the invention are illustrated and further define the programming of the microprocessor 100. In this regard, the flow charts illustrated in FIGS. 5 through 7 generally describe operations and programming to implement the play of the Game 5 type described hereinbefore, although it should be understood that the basic programming illustrated in FIGS. 5 through 7 also apply to the other seven games described hereinbefore and various other games with suitable modifications.

The main logic flow or control loop of the microprocessor 100 originates at the top of FIG. 5 at the START designation with a clear function being performed as to the contents of the memory of the microprocessor as well as the output control circuits. The main control of the microprocessor then proceeds through an increment maze sequence generator function to a decision block START SWITCH DOWN? wherein a determination is made whether or not the start switch 44 has been actuated. If the start switch has not been actuated, the logic control returns to again increment the maze sequence generator and continues to determine whether the start switch 44 has been actuated. If the start switch has been actuated, the logic control proceeds to read the game type as selected on switch 40 and properly initializes the indicators 46 and 48 and the display 45 according to the rules of the game selected as programmed in the microprocessor and described hereinbefore in connection with Game 5.

The logic control then proceeds to perform the function of erasing the previous switch/maze association table as stored in memory.

The logic control path then continues through a marker A of FIG. 5 to marker A of FIG. 6 whereupon the turn timer (performed by the internal timer or oscillator circuit in the microprocessor 100) is initialized to begin the timing of a round or turn. Next the turn timer is decremented or reduced by one time unit of the predetermined number of time intervals alloted to a turn as determined by the particular programming. Next a determination is made in the TIME UP? decision block whereupon the increment round count is incremented if the answer is yes, defined as the participant taking too long to operate one of the key pad switches after the turn has begun. If the answer is no (i.e. the time for a turn is not up after the most recent time unit decrement of the turn timer) the logic control proceeds to perform the sequential input/output functions to read the state of the key pad switch array 34-1 through 34-25 utilizing the internal logic circuits of the microprocessor to detect valid key pad switch operations in a debounce counting function. At this time, the microprocessor also controls the actuation of the indicators 44 and 46.

After these functions have been performed, the determination is made by the microprocessor in a decision block OUTPUT TONE? as to whether or not an output tone is required at this point. If the output state circuitry indicates that the determination is yes, the tone generator is initialized for enabling and the logic control flow proceeds to marker C at the start of FIG. 7 to define what type of tone sequence or melody is to be performed. If the determination in the OUTPUT TONE? decision block is negative, the tone generator is disabled and the flow proceeds to a determination block DONE MELODY? to determine whether a tone sequence or melody of one of various types is in progress or has been completed. If a tone sequence or melody is currently being performed by the tone generator (which of course is much slower than the logic control path flow) the control circuitry proceeds to determine the next tone type required to complete the tone sequence or carry on the tone sequence and the flow again proceeds to marker C to determine what type of melody is being performed.

If the tone sequence or current melody has been completed, the flow proceeds to a decision block where the determination is made whether or not the tone sequence or melody performed was a GAME END MELODY? If the determination is yes, the control path proceeds through marker E of FIG. 6 to the reference marker E of FIG. 5 at the start of the main logic control flow path. If the melody completed was not the end of game designation, a determination is made whether or not a new melody (tone sequence) is to be performed as indicated by the NEW MELODY? decision block. If the answer is yes, then a determination is made as to what type of tone sequence or melody is to be performed by interrogation of the memory. If the new melody or tone sequence is to be that of a winner-game end type, the determination in a decision block GAME END MELODY? (marker C of FIG. 7) is yes and the flow continues to reference marker D which enters the main flow path at reference marker D of FIG. 6, the No determination output of the TURN TIME UP decision block.

If the new melody is not the end of game type, the determination is then made in a decision block SWITCH DETECT? as to whether a key pad switch operation has been detected since the previous pass around the main logic control flow by interrogating the memory and the output state circuitry. If a key pad switch operation has not been stored, the flow proceeds through reference marker B to reference marker B of FIG. 6 between the initialize turn timer and decrement turn timer functions.

If a key pad switch operation has been detected, the round count is incremented and stored for subsequent use to update the display. Next a determination is made in a decision block MAZE TO SWITCH LINK? where the determination is made whether or not an association table between the maze sequence and key pad switches has been previously established in memory. If the answer is yes, the particular sequence element associated with the key pad switch that has been operates is recalled.

Next a determination is made in decision block CORRECT SWITCH? to determine whether this is the correct key pad switch corresponding to the present position of the maze sequence thus far established in memory as correctly performed by the game participant. If the determination in the MAZE TO SWITCH LINK? decision block is NO, i.e. there is no maze/switch association table currently in memory denoting the start of a game, a maze sequence generator is interrogated and a sequence/key pad switch association table is generated and stored for future use.

The logic control flow proceeds to the decision block CORRECT SWITCH? If the operated key pad switch is the next switch in the maze sequence as determined by the association table in memory, the display is updated and the logic control flow proceeds to a decision block GAME END? to determine if this is the switch corresponding to the last element (FINISH position) in the stored maze sequence. If the determination is yes, the logic flow proceeds through an initialize game end melody function to establish the proper state of the internal logic to prepare for the generation of a game end melody.

The logic control path proceeds through the reference marker A of FIG. 7 to marker A at the top of FIG. 6 to initialize the turn timer and again proceed through the logic control flow of FIG. 6. Proceeding through the control path of FIG. 6 as previously described, if the determination of the GAME END? decision block is no, the correct switch melody (green player melody) is initialized and again the logic control path continues to reference marker A to the initialize the turn timer functional block of FIG. 5 to proceed through another turn and to output a correct switch (green player) melody. Returning now to FIG. 7, if the determination in the decision block CORRECT SWITCH is NO, the display is updated from the information previously stored in the increment round count position in memory and the wrong or incorrect switch melody logic is initialized. Again, the logic control path now proceeds to reference marker A.

The reference marker F continued from the reference marker F of FIG. 6 at the output of the increment round count function, enters the logic control path at the initialize wrong switch melody and again back to the reference marker A. Thus, if the turn timer times out at the TURN TIME UP? decision block before the participant selects and operates the next key pad switch, the wrong or incorrect switch melody is initialized and thereafter produced as if an incorrect key pad had been actuated along with an increment of the round count.

Obviously many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electronic game device comprising:

a base;

a playing field array defined on said base and including a plurality of array elements defining a respective plurality of playing field array positions, each of said array elements being manually actuatable by a participant for entering the respective playing field array position represented by each of said array elements;

means having stored therein an internally generated maze path sequence including maze path sequence elements, each of said maze path sequence elements corresponding to a respective one of said array positions in said maze path sequence corresponding to a predetermined maze path on said playing field array in terms of said array positions;

entry control means responsive to actuation of said array elements for determining the relative position of said actuated array elements in said playing field array and for comparing the relative array position of said actuated array element with a predetermined maze path sequence element of said maze path sequence to determine the agreement of said actuated array element with said predetermined maze path sequence element;

maze path means responsive to said entry control means for determining said predetermined maze path sequence element of said maze path sequence, said predetermined maze path sequence element being successively increased by one element in said maze path sequence upon said entry control means determining agreement between said actuated array element and said predetermined maze path sequence element; and sensorially perceptible indicating means responsive to said entry control means for generating a first sensorially perceptible indication corresponding to agreement of said actuated array element with said predetermined maze path sequence element, a second sensorially perceptible indication different from said first sensorially perceptible indication corresponding to non-agreement of said actuated array element with said predetermined maze path sequence element, and a third completion of game indication corresponding to the agreement of said actuated array elements and the last sequence element of said maze path sequence.

2. An electronic game device as recited in claim 1 wherein each of said plurality of manually actuable array elements includes a key pad switch.

3. An electronic game device as recited in claim 1 wherein the first and last maze path elements of said maze path sequence respectively define the start and finish array positions of said maze path.

4. An electronic game device as recited in claim 1 wherein said entry control means operates to determine agreement between said actuated array elements and said maze path sequence from the beginning of said maze path sequence.

5. An electronic game device as recited in claim 1 wherein said maze path means is non-responsive to the entering of array positions not in agreement with said predetermined maze path sequence element.

6. An electronic game device as recited in claim 1 wherein said entry control means further comprises penalty means for controlling said maze path means to decrease said predetermined maze path sequence element by one or more sequence elements in response to an actuated array element not being in agreement with said predetermined maze path sequence element.

7. An electronic game device as recited in claim 6 wherein said penalty means decreases the predetermined maze path sequence element to the first element of said maze path sequence.

8. An electronic game device as recited in claim 1 wherein said three sensorially perceptible indications are aural.

9. An electronic game device as recited in claim 7 wherein at least one of said aural outputs comprises a combination of successive tones of different frequencies.

10. An electronic game device of claim 1 wherein said entry control means further comprises means for disregarding actuation of array elements not in agreement with the predetermined maze path sequence element.

11. An electronic game device as recited in claim 1 wherein said entry control means comprises program control means for controlling said entry control means to perform the comparing of said actuated array elements to said maze path sequence starting at a predetermined sequence element of said maze path sequence and progressing from element to element in said maze path sequence in either direction.

12. An electronic game device as recited in claim 1 further comprising mode means for controlling said electronic game device to operate in a predetermined number of different operational modes, said controlling means comprising manually operable means for selecting each of said predetermined number of different operational modes, said mode means modifying the characteristics of the predetermined maze path and the operation of said entry control means and said maze path means.

13. An electronic game device as recited in claim 1 further comprising means for generating sensorially perceptible outputs representing the first and last maze path sequence elements of said maze path sequence, said first maze path sequence element representing a start position on said playing field array and said last maze path sequence element representing a finish position on said playing field array.

14. An electronic game device as recited in claim 13 wherein said maze path sequence elements of said maze path sequence between said first and last sequence elements correspond to a continuous path of adjacent array positions on said playing field array between said start and finish array positions.

15. An electronic game device as recited in claim 14 wherein said manually positionable identifying means further comprises a player marker for each of the game participants.

16. An electronic game device as recited in claim 13 further comprising manually positionable marker means for identifying said start array positions and said finish array positions of said maze path.

17. An electronic game device comprising:

a base;

a playing field array defined on said base and including a plurality of array elements defining a respective plurality of playing field array positions, each of said array elements being manually actuatable by a participant for entering the respective playing field array position represented by each of said array elements;

means having stored therein an internally generated maze path sequence including maze path sequence elements, each of said maze path sequence elements corresponding to a respective one of said array positions in said maze path sequence corresponding to a predetermined maze path on said playing field array in terms of said array positions;

entry control means responsive to actuation of said array elements for determining the relative position of said actuated array elements in said playing field array and for comparing the relative array position of said actuated array element with a predetermined maze path sequence element of said maze path sequence to determine the agreement of said actuated array element with said predetermined maze path sequence element;

maze path means responsive to said entry control means for determining said predetermined maze path sequence element of said maze path sequence, said predetermined maze path sequence element being successively increased by one element in said maze path sequence upon said entry control means determining agreement between said actuated array element and said predetermined maze path sequence element;

sensorially perceptible indicating means responsive to said entry control means for generating a first sensorially perceptible indication corresponding to agreement of said actuated array element with said predetermined maze path sequence element and a second sensorially perceptible indication different from said first sensorially perceptible indication corresponding to non-agreement of said actuated array element with said predetermined maze path sequence element; and said entry control means further comprising penalty means for controlling said maze path means to decrease said predetermined maze path sequence element by one or more sequence elements in response to an actuated array element not being in agreement with said predetermined maze path sequence element.

18. An electronic game device as recited in claim 17 wherein said penalty means decreases the predetermined maze path sequence element to the first element of said maze path sequence.

19. An electronic game device comprising:

a base;

a playing field array defined on said base and including a plurality of array elements defining a respective plurality of playing field array positions, each of said array elements being manually actuatable by a participant for entering the respective playing field array position represented by each of said array elements;

means having stored therein an internally generated maze path sequence including maze path sequence elements, each of said maze path sequence elements corresponding to a respective one of said array positions in said maze path sequence corresponding to a predetermined maze path on said playing field array in terms of said array positions;

entry control means responsive to actuation of said array elements for determining the relative position of said actuated array elements in said playing field array and for comparing the relative array position of said actuated array element with a predetermined maze path sequence element of said maze path sequence to determine the agreement of said actuated array element with said predetermined maze path sequence element, said entry control means comprising means for disregarding actuation of array elements not in agreement with the predetermined maze path sequence elements;

maze path means responsive to said entry control means for determining said predetermined maze path sequence element of said maze path sequence, said predetermined maze path sequence element being successively increased by one element in said maze path sequence upon said entry control means determining agreement between said actuated array element and said predetermined maze path sequence element; and sensorially perceptible indicating means responsive to said entry control means for generating a first sensorially perceptible indication corresponding to agreement of said actuated array element with said predetermined maze path sequence element and a second sensorially perceptible indication different from said first sensorially perceptible indication corresponding to non-agreement of said actuated array element with said predetermined maze path sequence element.

20. An electronic game device comprising:

a base;

a playing field defining an M×N array including M times N array elements representing playing field array positions, each of said array elements including manually operable entry means operable by one or more game participants for entering the respective playing field array position represented by said array elements;

manually operable game initializing means;

entry control means responsive to operation of said manually operable entry means for providing an identification of the operated entry and the represented array elements in the M×n array;

maze path generation means responsive to operation of said initializing means for generating a maze path sequence defining a start array element, a finish array element and a continuous maze path of array elements between said start and finish array elements, said maze path sequence being generated on a random basis upon each operation of said initializing means;

display means responsive to said maze path generation means and said initializing means for displaying the start array element in said M×N array, said display means being responsive to said entry control means to terminate the display of said start array element upon operation of said array element entry means corresponding to said displayed start array element, said display means further comprising finish means responsive to operation of said array element entry means corresponding to said start array element for displaying the finish array element in said M×N array, said finish display means being responsive to said entry control means to terminate the display of said finish array element upon operation of said entry means corresponding to said displayed finish array element; and maze path control means responsive to said maze path generation means and said manually operable entry means for comparing entered array elements as represented by operation of said respective entry means with said maze path sequence elements one sequence element at a time, said maze path control means comprising;

means for providing one sequence element of said maze path sequence representing a comparison sequence element starting with said first maze path sequence element after said start array element, said sequence element providing means being responsive to a maze path sequence increment signal to provide the next successive element in said maze path sequence upon the occurrence of said maze path sequence increment signal;

means responsive to said sequence element providing means for comparing array elements entered by said entry means with said one sequence element, said comparing means comprising agreement and error means for generating a first maze path increment signal when said array element entered by said entry means is in agreement with said one sequence element representing the next array element along the maze path and a second error signal when said array element entered by said entering means is not in agreement with said one sequence element, said first maze path increment signal being connected to said sequence element providing means, and sensorially perceptible indicating means responsive to said agreement and error generating means for generating a first sensorially perceptible correct indication responsive to said first maze path increment signal and a second sensorially perceptible error indication responsive to said second error signal, said maze path control means operating element by element in said maze path sequence until said sequence element providing means is incremented to the maze path sequence element immediately preceding the finish array element and the array element entry means corresponding to the maze path sequence element immediately preceding the finish array element is operated.

21. The electronic game device of claim 20 further comprising a manually positionable start marker and a manually positionable finish marker, said start marker being positioned on said array element displayed as the start array element to operate said respective entry means, said finish marker being positioned on said array element displayed as the finish array element to operate said respective entry means.

22. The electronic game device of claim 21 further comprising manually positionable player marker means being disposed on said array elements to operate said respective entry means.

* * * * *